United States Patent [19]

Barriac

[11] Patent Number: 4,749,103

[45] Date of Patent: Jun. 7, 1988

[54] CHILD RESISTANT DISPENSING CLOSURE SYSTEM

[75] Inventor: Jacques J. Barriac, Toledo, Ohio

[73] Assignee: Owens-Illinois Closure Inc., Toledo, Ohio

[21] Appl. No.: 1,614

[22] Filed: Jan. 8, 1987

[51] Int. Cl.[4] ..... F65D 47/28

[52] U.S. Cl. ..... 222/48; 222/153; 222/525

[58] Field of Search ..... 222/153, 384, 522, 524, 222/525, 47, 48, 521, 520; 215/206, 223, 311

[56] References Cited

U.S. PATENT DOCUMENTS

| | | | |
|---|---|---|---|
| 3,032,240 | 5/1962 | Dunklee | 222/525 |
| 3,305,127 | 2/1967 | Baranne | 222/522 X |
| 3,559,832 | 2/1971 | Balducci | 215/223 |
| 3,599,845 | 8/1971 | Miller | 222/525 |
| 3,777,936 | 12/1973 | Hazard | 222/525 X |
| 3,782,574 | 1/1974 | Rumble | 215/223 |
| 4,020,981 | 5/1977 | Nixdorff | 222/525 |
| 4,065,037 | 12/1977 | Haller | 222/153 |
| 4,162,746 | 7/1979 | Anderson et al. | 222/384 X |
| 4,420,096 | 12/1983 | Kirk | 222/153 X |
| 4,479,589 | 10/1984 | Ford | 222/153 |

FOREIGN PATENT DOCUMENTS

| | | | |
|---|---|---|---|
| 913033 | 5/1946 | France | 222/525 |

*Primary Examiner*—Joseph J. Rolla
*Assistant Examiner*—Frederick R. Handren

[57] ABSTRACT

A child resistant dispensing closure having a pourout style spout that is telescopically mounted on a cylindrical extension of the closure. The closure is described with two embodiments of a push-pull spout. In both cases the closure threads onto a container finish and a pourout spout of the push-pull type is mounted on a cylindrical extension of the closure. The closure extension has a side opening adjacent the closed upper end through which the contents may be dispensed. The spout effectively closes the opening when in assembled form. Interengaging beads and lugs formed on the exterior of said closure and interior of said spout define the only relative rotational position that permits the spout being pulled up on the closure to uncover the opening therein. The proper rotational position is indicated when indicia on the spout and closure are aligned.

4 Claims, 5 Drawing Sheets

CHILD RESISTANT DISPENSING CLOSURE SYSTEM

BACKGROUND OF THE INVENTION

This invention relates to a child resistant dispensing closure for necked containers and, more particularly, to a push-pull closure with a child resistant dispensing spout. There are a wide variety of child resistant packages where at least one feature of the closure has a child resistant aspect. Such prior art disclosures, as found in U.S. Pat. Nos. 4,358,031 to Lohrman, and 4,314,656 to Kessler, require the squeezing of the skirt of the outer member to permit rotation of the outer member relative to a container or fitment to effect opening of the dispensing spout that is positioned inside the closure. In one case, axial pulling of the closure relative to the dispensing spout is accomplished while in the other patent partial unthreading of the outer closure exposes the interior of the spout. The push-pull dispensing closure without any child resistant feature is described in U.S. Pat. No. 3,885,712 to Libit, dated May 27, 1975.

SUMMARY OF THE INVENTION

In accordance with the present invention, a child resistant dispensing closure is provided in which a dispensing closure having dispensing spout is threaded on the container neck and has a push-pull over-cap closing the dispensing spout with a child resistant system preventing accidental pulling of the spout relative to the closure and requiring the alignment of indicia on the spout and closure top in order to permit axial movement of the spout relative to the closure to open the dispensing opening of the closure. Additionally, in one embodiment the closure is locked against unthreading from the container once the closure is fully applied. In a second embodiment the spout is provided with a skirt portion that extends to below the lower end of spaced, vertical ribs on the closure skirt and with an inwardly extending interrupted bead on the lower end of the skirt of the over-cap to cooperate with the ribs to permit pulling of the over-cap only when in proper alignment to open the dispensing spout and facilitate the unthreading of the closure from the container, if desired.

It is therefore an object of the present invention to provide a child resistant, push-pull dispensing closure for a container in one embodiment of which the closure is not removable from the container and in a second embodiment is removable with a child resistant feature. In both cases the dispensing feature is child resistant also, thus child resistance of the closure is built in both in the application and removal from the container, as well as the push-pull dispensing feature.

Other objects will become apparent from the following description taken in conjunction with the annexed sheets of drawings wherein.

DETAILED DESCRIPTION OF THE DRAWINGS

Figure 1:
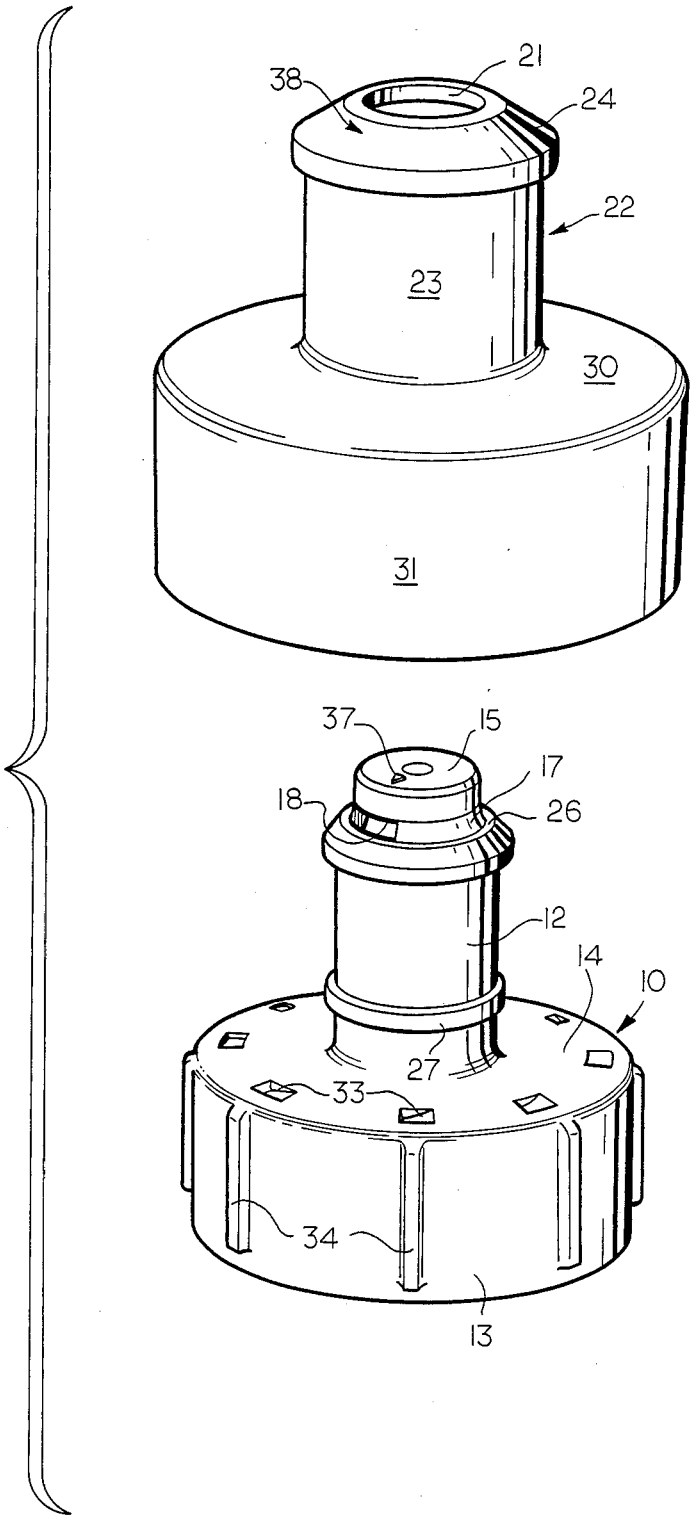
FIG. 1 is an exploded perspective view of a first embodiment of the dispensing closure of the invention.

Considering that child resistant closures for threaded containers are fairly well accepted, in particular those that are called "press-twist" where an outer shell is biased away from the inner shell or a closure that is threaded on the container and interengaging means between the two shells have to be actuated by external force on the outer shell, it would be advantageous to provide the same or greater degree of security for a dispensing closure which threads on the container, but is capable of dispensing a powder or liquid, such as a detergent, without removing the closure.

Referring to FIGS. 1–4, a threaded closure 10 threads onto a container neck 11 with the usual clockwise rotation of the closure relative to the container neck. An annular dispensing neck or cylindrical member 12 is formed integrally with a cylindrical skirt threaded portion 13. The skirt 13 is of larger diameter than the neck 12 which is joined thereto by a generally horizontal disc portion or panel 14. The upper end of the neck 12 is formed with a circular top 15 which effectively closes the upper end of a passageway or central core 16 within the neck. The top 15 is of smaller cross-section than the neck 12 and is joined to the neck by a frusto-conical wall 17. The wall 17 is interrupted at 18 to form an opening through the neck 12 to the outside. Immediately below the wall 17 the neck 12 is formed with a radially outward extending, annular bead 19. Also, within the neck 12 a bridge 20 is formed which extends from the inner wall of the neck to the underneath of the top wall 15. This bridge is positioned relative to the opening 18 to serve as a reinforcing member to prevent the top wall 15 from being pushed down and avoid the annular seal that the top wall makes with an upper, inner annular surface 21 of a spout 22.

The spout 22 has a cylindrical side wall 23 that telescopes over the neck 12 of the closure 10. The upper end of the spout 22 is formed with the inwardly facing, annular sealing surface 21 of an inwardly extending top member 24. The externally formed, upper surface area of the top member 24 presents an annular bead adapted for grasping to facilitate pulling and/or rotating the spout relative to the closure. The top member 24 also forms an inwardly extending ledge 25 that is in engagement with a complimentary, flat surface 26 on the exterior of the neck 12 just below the frusto-conical surface 17.

The spout 22 has an internal diameter that is generally the same as the external diameter of the bead 19 on the spout neck 12. Beneath the stop bead 19 and spaced therefrom a predetermined distance is a radial bead 27. Within the vertical bore within the wall 23 the spout 22 has an inwardly extending stop bead 29 whose function is to cooperate with the stop bead 19 on the neck 12 to prevent axial movement of the spout from the neck.

At the bottom of the cylindrical wall 23, the spout carries an outwardly extending, generally horizontal wall portion 30 which in turn terminates in a vertical, cylindrical skirt portion 31. As shown in the drawings, the horizontal wall portion 30 overlies the disc portion 14 of the closure 10 and the skirt 31 of the spout overlies the skirt 13 of the closure.

Figure 2:
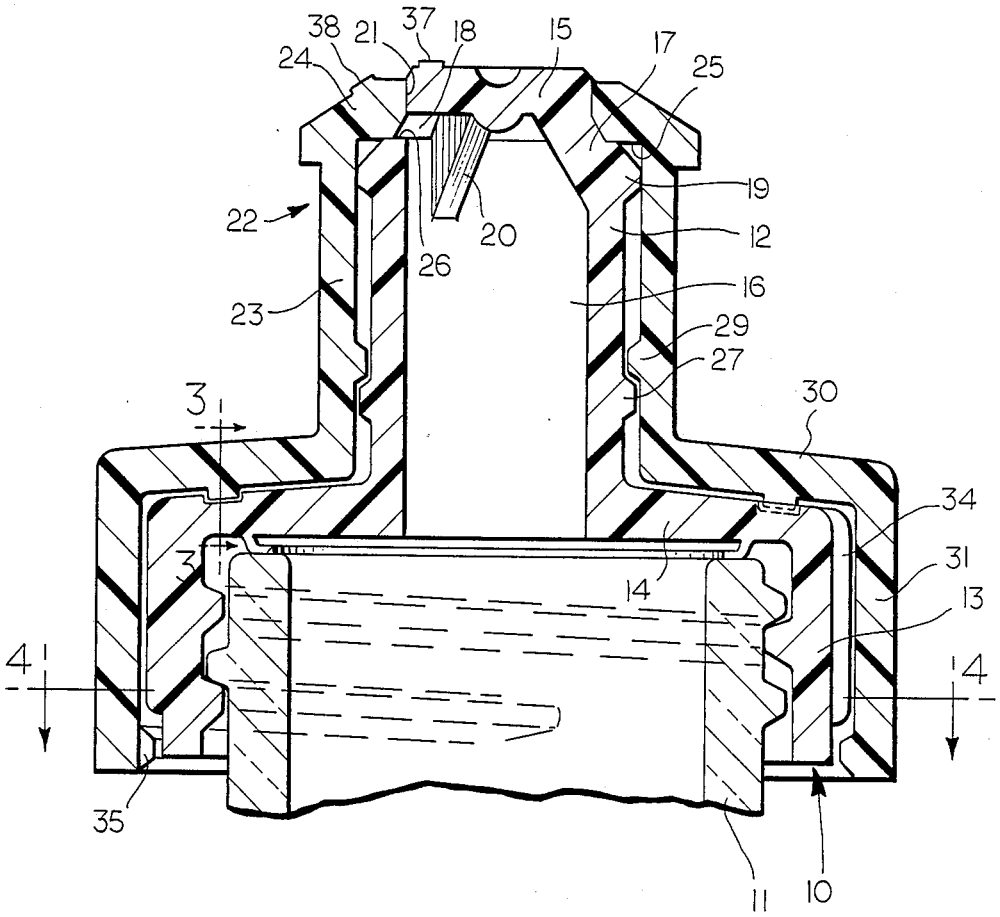
FIG. 2 is a vertical, sectional view through the closure of FIG. 1 in assembled form and applied to a container neck.
Figure 3:
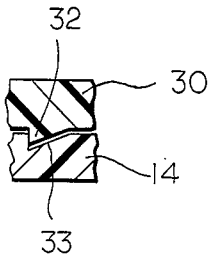
FIG. 3 is a cross-sectional view taken at line 3—3 of FIG. 2.
Figure 4:
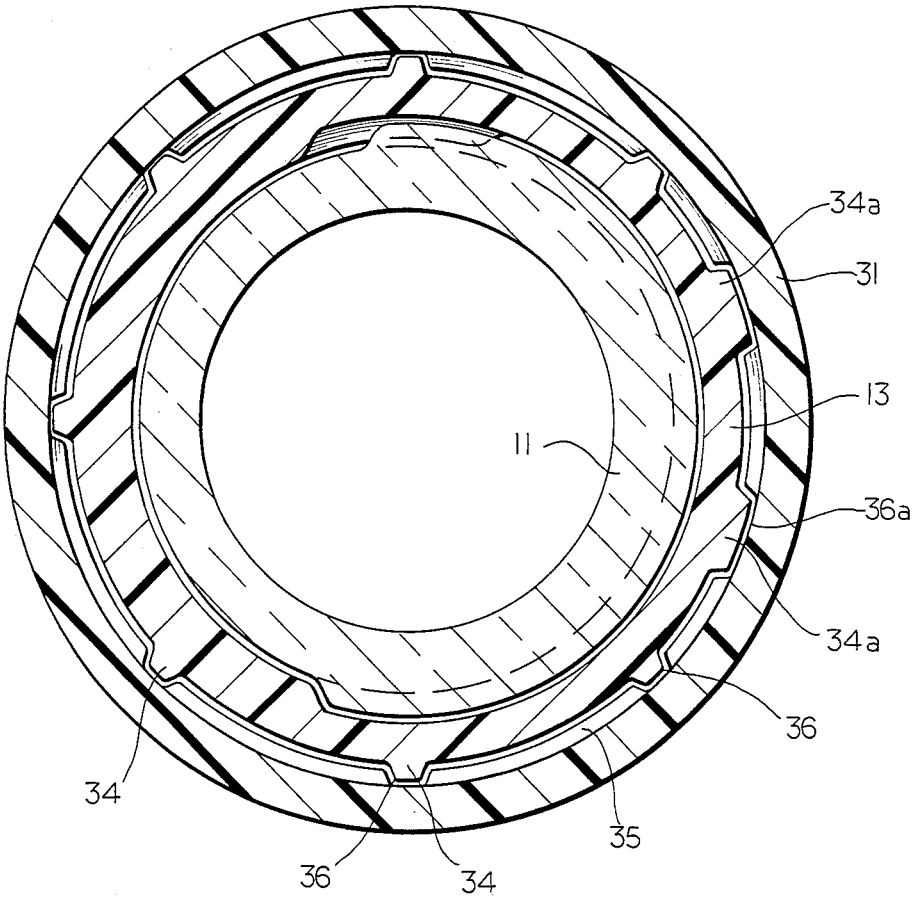
FIG. 4 is a cross-sectional view taken at line 4—4 of FIG. 2.

When the closure 10 and spout 22 are in assembled relationship, as shown in FIG. 2, threading of the closure onto the finish of the container 11 is facilitated by the engagement of ratchet teeth 32 formed at spaced intervals in the underneath surface of the horizontal wall 30 of the spout with ramped grooves 33 formed in the upper surface of the disc portion 14 of the closure. In this manner the rotation of the spout in a clockwise direction will thread the underlying closure 10 on the container 11. However, turning the spout in the opposite direction will cause the ratchet teeth to move up the ramps of the grooves 33 and not unscrew the closure 10.

The skirt 13, as best shown in FIG. 1, has a series of vertical ribs 34 extending outward therefrom which span the gap between the skirt 13 of the closure and the skirt 31 of the spout. The ribs 34 terminate at a point above the bottom of the skirt. The skirt 31, at its lower edge, is formed with an inwardly extending, interrupted bead or lugs 35. The interruptions 36 in the bead 35 coincide with the ribs 34 on the skirt 13. It should be noted, however, that at least one rib **34*a* is of larger cross-section than the other ribs 34. Likewise, at least one interruption 36*a* will be greater than some of the others so that relative axial movement of the spout on the closure can only occur when the spout and closure are in a specific, relative rotational position. This position is shown by the indicium 37 on the top 15 of the closure being in alignment with the indicium 38 on the top 24** of the spout.

Alternatively, but not illustrated, the ribs 34 on the closure skirt may be unequally spaced about the skirt and the interruptions in the bead 35 on the skirt of the spout also will be unequally spaced so that there is only one relative rotational position of the spout and closure which will permit axial movement of the spout relative to the closure.

Obviously, the removal of the closure can be accomplished only with the spout pulled up on the closure so that the ribs 34, **34*a* are engaged by the bead 35 and then torque applied to the spout will be transmitted to the closure. Also, dispensing of the contents from the container through the opening 18 in the neck 12 of the closure can only occur when the spout surface 21 clears the cylindrical outer surface of the top 15 which closes the opening in the spout. The spout is assembled on the closure by forcing their assembly where the bead 29 must pass over the bead 19**.

Figure 5:
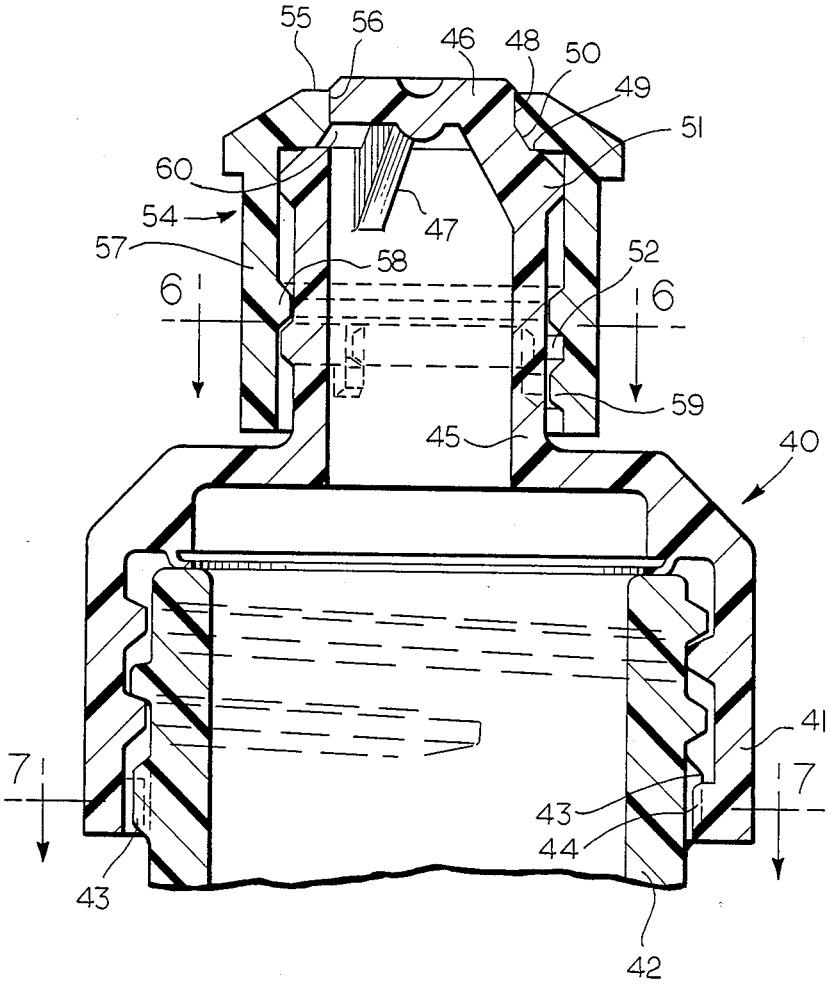
FIG. 5 is a vertical cross-sectional view of a second embodiment of the child resistant dispensing closure of the invention.
Figure 6:
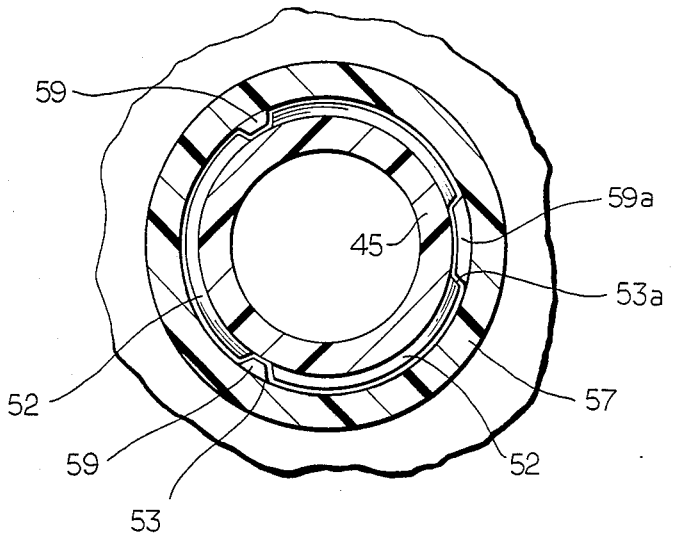
FIG. 6 is a cross-sectional view taken at line 6—6 of FIG. 5.
Figure 7:
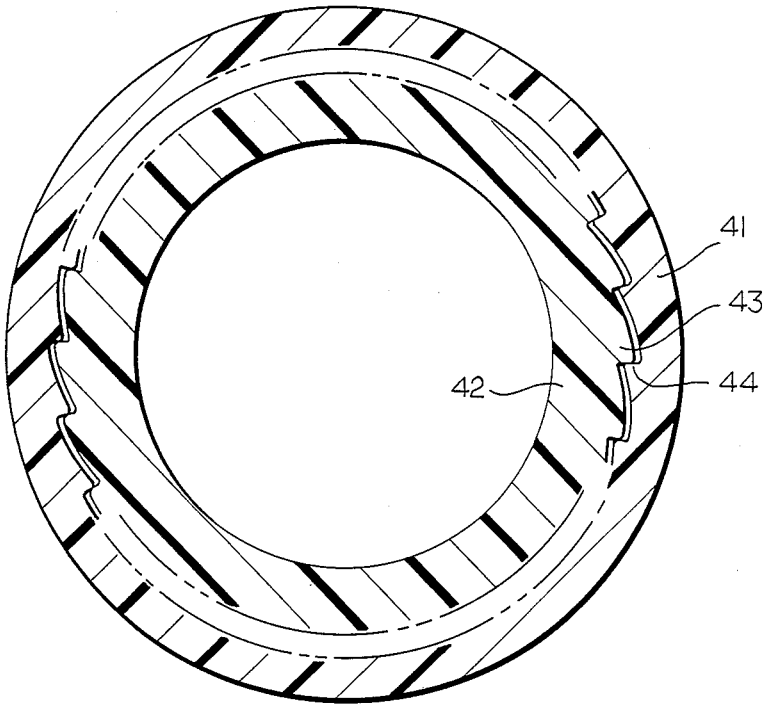
FIG. 7 is a cross-sectional view taken at line 7—7 of FIG. 5.

Turning now to FIGS. 5–7, the second embodiment of the invention of a child resistant push-pull pourout closure is illustrated. In this embodiment, once the closure is threaded on the container, it is locked on and, in effect, is child resistant in that the closure cannot be removed. The closure 40 has a depending skirt 41 with internal threads which may cooperate with external threads formed on the finish or neck of a container 42. Immediately beneath the threads on the container neck the container has series of ratchet teeth 43 which will interlock with similar ratchet teeth 44 formed on the interior of the skirt 41 of the closure in the annular area thereof beneath the threads (see FIG. 7). The closure can be easily assembled to the container by rotation in the threading-on direction but reverse rotation is prevented.

As in the first embodiment, the closure 40 has an integrally formed cylindrical member or dispensing neck 45. The neck 45 is closed at its upper end by a top 46 which has a reinforcing bridge 47. A cylindrical surface 48 extends down from the top and joins an annular ledge 49 by way of a frusto-conical surface 50. Beneath the ledge 49 an outstanding stop bead 51 is formed adjacent to the upper end of the neck 45. Below the bead 51, at a predetermined distance, an interrupted annular bead 52 is formed. As best illustrated in FIG. 6, the bead 52 shows a pair of interruptions or gaps 53 of one size and one gap **53*a*** of another size.

A spout 54 is telescoped over and surrounds the neck 45 of the closure. The spout 54 has an upper configuration which is essentially the same as that illustrated in FIG. 1 for the first embodiment and consists of a top 55 with an opening 56 within which the surface 48 of the closure seats and seals. A cylindrical side wall 57 of the spout 54 has an inwardly extending full annular stop bead 58 which will cooperate with the stop bead 51 on the closure neck 45 to limit the relative axial displacement of the spout on the neck 45. Below the bead 58 are a horizontal series of inwardly extending lugs 59 (see FIG. 6), with two of the lugs being of a size that will pass through the gaps 53 of the bead 52 and one lug **59*a* being greater in circumferential extent than the others. The lug 59*a* is of a size that it can pass through the gap 53*a*. While two gaps 53 of one size and a single gap of another size is illustrated as cooperating with lugs 59 and 59*a*, it should be understood that, functionally, a single lug and single gap would suffice to achieve the result desired. When the spout 57 and neck 45 are circumferentially aligned, as shown in FIGS. 1 and 6, indicium on the top 46, as illustrated in FIG. 1, will be aligned with indicium on the spout top 55. The spout may be moved vertically upward until the stop beads 51 and 58 contact each other. This relative movement, caused by pulling on the spout, will open a dispensing opening 60 in the conical surface 50, permitting the pourable contents of the container to flow therethrough. After passing through the opening 60, the contents will enter the interior of the spout and exit out through the central opening 56** in the spout.

While the dispensing closure and spout illustrated in the attached drawings is primarily for the liquid or pourable powders which may be injurious to children, such as bleach, detergents, lye, etc., the closure could be used for a container of flowable paste which could be packaged in a flexible plastic container where flow could be induced by squeezing the bottle.

What is claimed:

1. A child resistant dispensing closure in combination with a container having an externally threaded neck, comprising a closure with a threaded skirt and formed with a horizontal panel for sealingly engaging the top of the container neck when threaded thereon, an integrally formed annular, cylindrical member extending vertically from the center of said panel, a first outwardly extending radial bead adjacent the upper end of said cylindrical member and an inwardly and upwardly tapered annular area extending above the first bead on said cylindrical member, a round, horizontal top closing the upper end of said cylindrical member with a portion of said upwardly tapered annular area removed to provide a pourout opening communicating with the interior of the container via the cylindrical member, a second outwardly extending radial bead about said cylindrical member at a location above the horizontal panel of said closure but closer thereto than the first bead, a dispensing spout telescopically positioned over said cylindrical member, said spout having an inwardly extending annular bead overlying the second bead on said cylindrical member, interengaging means formed on said spout and said closure for preventing axial movement of said spout relative to said closure except at a single, relative circumferential position, said spout having an externally formed upper surface area adapted for grasping to facilitate pulling and rotating said spout on said cylindrical member, said spout having a top wall with a downwardly and outwardly tapered, inner annular surface adapted to seat on the upper end of said cylindrical member and the tapered area thereof and an opening formed in said top wall within which the round top of said cylindrical member seats with its upper surface substantially coplanar with the top wall of said spout, said spout is formed with a horizontal outwardly radially extending wall at the bottom thereof and a downwardly extending cylindrical skirt joined to the outer edge of said horizontal wall, with said horizontal wall overlying the panel of said closure and said skirt surrounding the skirt of said closure, interengaging ratchet and ramped groove means formed between said horizontal wall of said spout and the top wall of said closure for permitting relative rotation of said spout and closure in one direction only, and cooperating indicia means on said top wall of said spout and the round top of said cylindrical member for indicating when said spout is circumferentially aligned with said cylindrical member so that the spout may be axially moved relative to said cylindrical member.

2. A child resistant dispensing closure in combination with a container having an externally threaded neck, comprising a threaded closure formed with a horizontal panel for sealingly engaging the top of the container neck, an integrally formed annular, cylindrical member extending vertically from the center of said panel, a first outwardly extending radial bead adjacent the upper end of said cylindrical member and an inwardly and upwardly tapered annular area extending above the first bead on said cylindrical member, a round, horizontal top closing the upper end of said cylindrical member with a portion of said upwardly tapered annular area removed to provide a pourout opening communicating with the interior of the container via the cylindrical member, a second outwardly extending radial bead about said cylindrical member at a location above the horizontal panel of said closure but closer thereto than the first bead, said second bead having at least one interruption formed therein, a dispensing spout telescopically positioned over said cylindrical member for axial movement between a lower closed position and an upper open position, said spout having an inwardly extending annular bead overlying the second bead on said cylindrical member, at least one lug extending inwardly of said spout in underlying relationship to said second bead on said cylindrical member when the spout is in the closed position, said lug having a circumferential dimension slightly less than the interruption in the second bead of said cylindrical member, said spout having an externally formed upper surface area adapted for grasping to facilitate pulling and rotating said spout on said cylindrical member, said spout having a top wall with a downwardly and outwardly tapered, inner annular surface adapted to seat on the upper end of said cylindrical member and the tapered area thereof and an opening formed in said top wall within which the round top of said cylindrical member seats with its upper surface substantially coplanar with the top wall of said spout and cooperating indicia means on said top wall of said spout and the round top of said cylindrical member for indicating when the lug on said spout is aligned with the interruption in the second bead on said cylindrical member to facilitate raising the spout relative to said cylindrical member.

3. The combination of claim 2 wherein said second bead is formed with a plurality of equispaced interruptions and said spout is formed with a corresponding number of lugs and wherein one of said lugs and interruptions is of a larger dimension than the others so that the spout can be pulled up only when the relative rotational positions of said spout and closure are indicated by said indicia.

4. A child resistant dispensing closure for a container neck comprising a generally cylindrical skirt portion with internal threads adapted to cooperate with threads on the container neck, interengaging (one-way) ratchet teeth on said container neck and closure skirt beneath the threads for maintaining the closure threaded on the container neck, an annular dispensing neck of smaller diameter than the closure skirt, integrally formed with and extending vertically from the top of said closure, a cylindrical push-pull spout telescopically mounted on said dispensing neck of said closure for axial movement between a lower closed position an an upper open position, said dispensing neck of said closure being formed with a first outwardly extending annular bead adjacent the upper end thereof and a second outwardly extending annular bead spaced below said first bead, said second bead having at least one interruption in its circumference, said spout being formed with at least one inwardly extending lug, positioned below the second bead of said dispensing neck when the spout is in the closed position, said spout normally surrounding said dispensing neck and having an upper inwardly extending annular top rim seated on the top of the dispensing neck, said dispensing neck being formed with a closed top with the exception of one area between the upper bead and the closed top through which a product in the interior of said closure can flow outwardly when the outer spout is rotated to a specific position to align the lug with the interruption and permit the spout to be pulled vertically upward.

* * * * *